US011180947B2

(12) United States Patent
Alkarram

(10) Patent No.: US 11,180,947 B2
(45) Date of Patent: Nov. 23, 2021

(54) CORNER SUPPORT ASSEMBLY FOR METAL FRAMED DOORS AND METHOD OF ASSEMBLAGE

(71) Applicant: Saleh Alkarram, Brooklyn, NY (US)

(72) Inventor: Saleh Alkarram, Brooklyn, NY (US)

( * ) Notice: Subject to any disclaimer, the term of this patent is extended or adjusted under 35 U.S.C. 154(b) by 304 days.

(21) Appl. No.: 16/366,445

(22) Filed: Mar. 27, 2019

(65) Prior Publication Data

US 2020/0308899 A1 Oct. 1, 2020

(51) Int. Cl.

| | |
|---|---|
| ***E06B 1/04*** | (2006.01) |
| ***E06B 3/46*** | (2006.01) |
| *E05D 15/06* | (2006.01) |
| *E06B 3/54* | (2006.01) |

(52) U.S. Cl.

CPC ..... *E06B 3/4636* (2013.01); *E05D 15/0652* (2013.01); *E05D 15/0686* (2013.01); *E05D 15/0691* (2013.01); *E05Y 2201/614* (2013.01); *E05Y 2900/00* (2013.01); *E06B 3/5454* (2013.01)

(58) Field of Classification Search

CPC ..... E06B 3/4636; E06B 3/5454; E06B 3/964; E05D 15/0686; E05D 15/0625; E05D 15/0691; E05Y 2201/614; E05Y 2900/00

See application file for complete search history.

(56) References Cited

U.S. PATENT DOCUMENTS 4,240,552 A 12/1980 Brown
4,356,672 A * 11/1982 Beckman ..... E04B 2/7453 52/238.1
5,125,201 A * 6/1992 Pieters ..... E04B 2/822 52/238.1
5,444,958 A * 8/1995 Lu ..... E05D 7/1005 52/204.67
5,546,718 A * 8/1996 Way ..... E04B 2/7409 160/135
5,694,722 A * 12/1997 Husting ..... A47K 3/30 296/96.21
5,806,261 A * 9/1998 Huebner ..... E04B 2/7407 52/283

(Continued)

FOREIGN PATENT DOCUMENTS

DE 2362875 A1 * 6/1975 ..... E06B 3/4609
EP 0294170 A1 * 12/1988 ..... E06B 3/96

*Primary Examiner* — Jerry E Redman
(74) *Attorney, Agent, or Firm* — Vincent G. LoTempio

(57) ABSTRACT

A corner support assembly for metal framed doors reinforces mounting of a metal door, so that the door molding easily attaches to extruded vertical and horizontal frame members of the corner support assembly. A top wall of the frame members with guide lines and molding that sits into a snap-fit mating relationship with corresponding frame members; thereby negating the need for notching. A heavy shear block provides structural integrity. The shear block abuts the intersection of the horizontal and vertical frame members, sliding between molding grooves in the vertical frame member. The shear block and horizontal and vertical frame members are secured into place with at least one of: a shear screw and a plug weld. An elongated threaded bolt reinforces connections between the horizontal and vertical frame members. A rubber glass setting block rests adjacent to the top wall of frame members to receive a glass pane.

20 Claims, 12 Drawing Sheets

(56) References Cited

U.S. PATENT DOCUMENTS

| | | | | |
|---|---|---|---|---|
| 5,875,596 | A * | 3/1999 | Muller | E04B 2/7433 52/239 |
| 6,434,905 | B1 | 8/2002 | Sprague | |
| D480,200 | S | 9/2003 | Sprague | |
| 8,341,903 | B2 * | 1/2013 | Haab | E06B 3/5454 52/238.1 |
| D725,457 | S | 3/2015 | Sprague | |
| 9,364,121 | B2 | 6/2016 | Sprague | |
| 10,676,936 | B2 * | 6/2020 | Lemiegre | E04C 3/28 |
| 2005/0081981 | A1 * | 4/2005 | Heikkila | E06B 3/5454 156/109 |
| 2008/0034702 | A1 * | 2/2008 | Garries | E06B 3/9641 52/656.2 |
| 2015/0275513 | A1 * | 10/2015 | Feldpausch | E06B 1/36 52/213 |
| 2018/0038144 | A1 * | 2/2018 | Metzger | E06B 3/26 |
| 2018/0112404 | A1 * | 4/2018 | De Maeyer | E06B 3/9645 |

* cited by examiner

CORNER SUPPORT ASSEMBLY FOR METAL FRAMED DOORS AND METHOD OF ASSEMBLAGE

FIELD OF THE INVENTION

The present invention relates generally to a corner support assembly for metal framed doors. More so, the present invention relates to a corner support assembly that provides a dimensionally stable reinforcement for fastening a metal door with molding, so that the door molding easily attaches to extruded vertical and horizontal frame members of the corner support assembly in a snap-fit relationship without the need for notching; whereby the frame members are secured into place with screws, welds, and threaded bolts; whereby shear blocks slide into mold installation grooves in the vertical frame member with screws at each corner; whereby the shear block has multiple holes that allow solder to be poured into the dedicated holes for a plug weld to fasten the shear blocks to the horizontal frame members; whereby the shear blocks help prevent shearing and increases structural integrity of the corner support assembly; whereby an elongated threaded bolt reinforces the connection between the horizontal and vertical frame members; and whereby a rubber glass setting block rests on the frame members to securely receive a glass pane.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, commercial metal framed doors are supported within a metal framework. Often the metal frame is made of aluminum extrusions. The metal framework is configured to form corner joints between the horizontal and vertical frames. Often, these commercial metal framed doors undergo heavy use which can torque the metal configuration. This shearing force creates a great amount of stress at the door corner joints. In many instances, commercial doors utilize corner joints that can withstand such forces. However, the corner joint can be bulky and cumbersome, and subject to failure from the shearing and torqueing forces which result from heavy duty use of the commercial metal door.

Other proposals have involved metal commercial door support frameworks. The problem with these door support frameworks is that they do not have multiple fastening means. Also, they require the door molding to be notched to mount the support structure. Even though the above cited door support frameworks meet some of the needs of the market, a corner support assembly for metal framed doors provides a dimensionally stable reinforcement for fastening a metal door with molding, so that the door molding easily attaches to extruded vertical and horizontal frame members of the corner support assembly in a snap-fit relationship without the need for notching; whereby the frame members are secured into place with screws, welds, and threaded bolts, is still desired.

SUMMARY

Illustrative embodiments of the disclosure are generally directed to a corner support assembly for metal framed doors. The corner support assembly provides a dimensionally stable reinforcement for fastening a metal door with a door molding, so that the door molding easily attaches to extruded vertical and horizontal frame members of the corner support assembly in a snap-fit relationship without the need for notching. The horizontal and vertical frame members are secured into place with both screws and welds.

Shear blocks are used at the intersection of the vertical and horizontal frame members to help prevent shearing and increase structural integrity of the corner support assembly. The shear blocks are configured to slide into grooves in the vertical frame member and remain fastened in place. At least one shear screw, a fillet weld and a shear block at each corner help secure the frame members.

The shear block has multiple holes that allow solder to be poured into the dedicated holes for a plug weld to fasten the shear blocks to horizontal frame members. An elongated ⅜" threaded bolt reinforces the connection between the horizontal and vertical frame members. A rubber glass setting block is applied on the inside of frame members for full glass edge protection.

In one aspect, a corner support assembly for metal framed doors, comprises:

- a pair of vertical frame members comprising a top wall defined by vertical molding installation grooves, a vertical frame bolt hole, and a vertical frame fastener hole, the vertical frame members further comprising a bottom wall, sidewalls, and ends defining a substantially rectangular cross section passageway extending longitudinally;
- a pair of horizontal frame members comprising a top wall having horizontal molding installation grooves, a bottom wall, sidewalls, and ends defining a substantially rectangular cross section passageway extending longitudinally, the horizontal frame members defined by an open space between the walls, the horizontal and vertical frame members joining at the ends to form a rectangular shape;
- at least one self-tapping screw operable to pass through a door frame and the top wall of the horizontal frame members, the self-tapping screw helping to fasten the door frame to the horizontal frame members;
- at least one fillet weld at the intersection of the shear block, the vertical frame member, and the horizontal frame member;
- at least one shear block defined by a U-shaped cross section, the shear block comprising a pair of shear walls and an abutment wall, the abutment wall abutting the top wall of the vertical frame members, the abutment wall defined by a pair of rails, whereby the grooves in the vertical frame members slidably receive the rails, the abutment wall further being defined by a shear fastener hole, a shear bolt hole, and a shear plug weld hole;
- a plate disposed adjacent to the abutment wall of the shear block and the top wall of the vertical frame members, the plate defined by a plate fastener hole and a plate bolt hole;
- at least one shear screw passing through the shear fastener hole and the plate fastener hole, the shear screw helping to fasten the shear block to the vertical frame member;
- at least one plug weld at the plug weld hole, the plug weld helping to fasten the shear block to the horizontal frame member;
- at least one elongated threaded bolt extending between the top walls of the vertical frame members, the threaded bolt passing through open space in the horizontal frame members, the threaded bolt further passing through the shear bolt hole, the vertical frame bolt hole, and the plate bolt hole, the threaded bolt helping to fasten the horizontal and vertical frame members; and at least one bolt nut mating with the threaded bolt to help fasten the plate to the vertical frame member.

In another aspect, the frame members are extruded.

In another aspect, the vertical frame members include at least one of the following dimensions: 2"×1¾"×⅛"; and 3½"×1¾"×⅛"; and 5"×1¾"×⅛.

In another aspect, the horizontal frame member includes at least one of the following dimensions: 2"×1 11/16"×⅛", 3½"×1 11/16"×⅛", 5"×1 11/16"×⅛", 7½"×1 11/16"×⅛", and 10"×1 11/16"×⅛".

In another aspect, the vertical and horizontal molding installation grooves mate with the door frame.

In another aspect, the threaded bolt comprises a ⅜" zinc plated steel threaded rod.

In another aspect, the bolt nut comprises a ⅜ inch-16 zinc plated nut.

In another aspect, the shear screw comprises a ¼ inch-20×1 inch zinc plated stainless steel socket cap head screw.

In another aspect, the plate comprises a zinc plated steel mounting plate.

In another aspect, the plug weld comprises a 7/32" plug weld.

In another aspect, the fillet weld has a length up to 1⅛ inches.

In another aspect, the door frame supports a metal door.

In another aspect, the metal door comprises a ¼ inch or a 1 inch insulated pane of glass.

In another aspect, the assembly further comprises a glass setting block operable to receive the pane of glass, the glass setting block resting on the top wall of the horizontal frame members.

In another aspect, the glass setting block is fabricated from rubber.

In another aspect, the dimension of the glass setting block comprise ¾ inch×1 inch×¼ inch.

In another aspect, the assembly comprises an adhesive applied on the self-tapping screw.

In another aspect, the self-tapping screw comprises a #10—16×¾ inch self-tapping hex washer head zinc plated steel screw.

One objective of the present invention is to support a metal framed door in a corner of a structure.

Another objective is to provide the strongest fastening and welding in regard to the assembly of aluminum commercial doors.

Yet another objective is to allows for a long fillet weld at all connection corners up to 1⅛" in length of continuous fillet weld without any notching or modification to the door vertical rails, top rails, bottom rails, mid rails, and the door moldings.

Another exemplary objective is to allow for compressing, connecting, and fastening all vertical rails and all top & bottom rails together with a ⅜"-16 zinc plated steel threaded rod, so as to insure enhanced fastening strength and back up fastening.

Additional objectives are to slide the shear block into the door vertical rails, insuring a stronger connection between the heavy shear blocks to the door vertical rails.

Another exemplary objective is to provide an inexpensive to manufacture corner door assembly.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1:
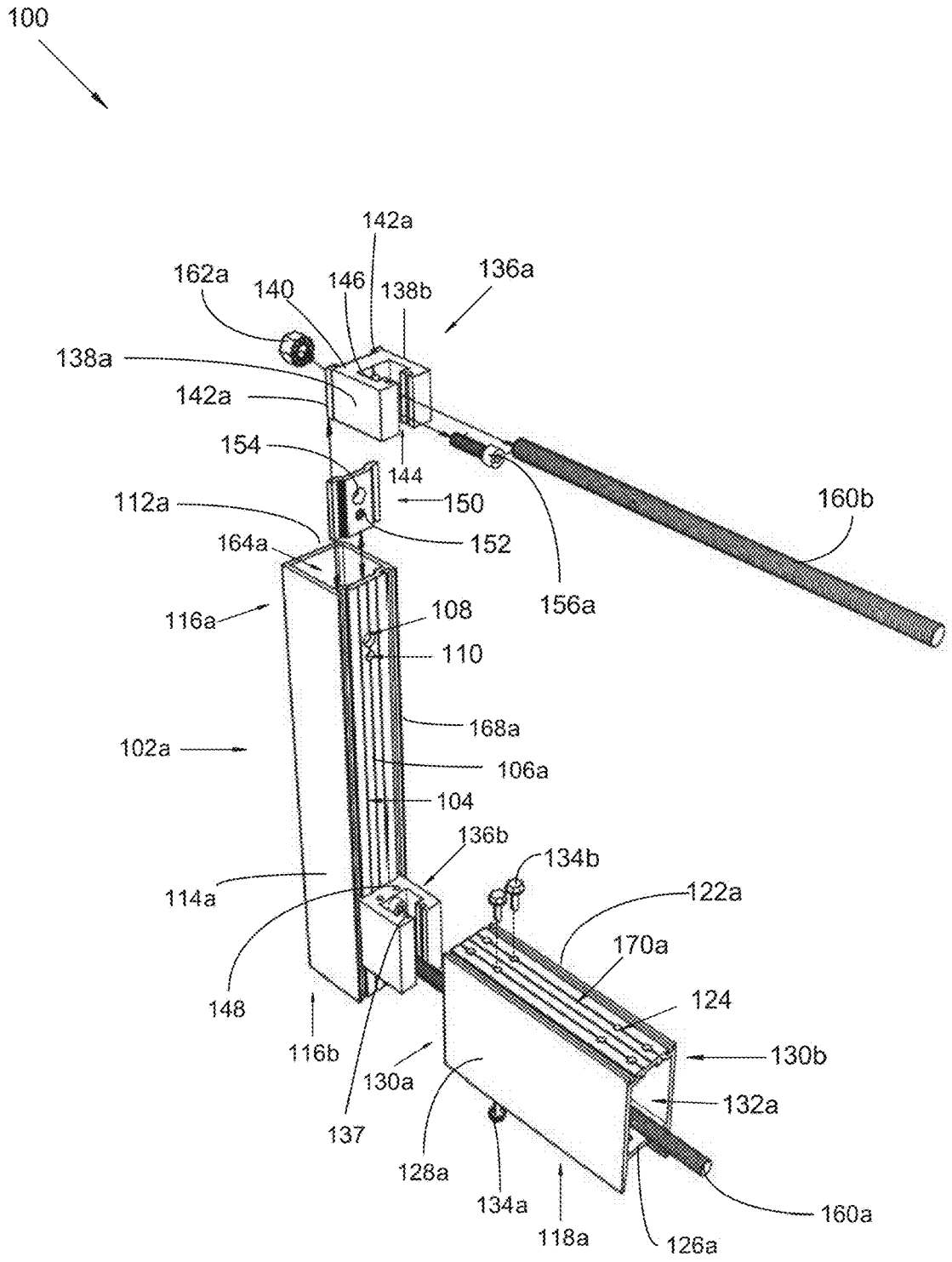
FIG. 1 illustrates a perspective view of an exemplary corner support assembly for metal framed doors, in accordance with an embodiment of the present invention.

FIGS. 1-12B reference a corner support assembly 100 for metal framed doors and method 1200 of assembly. As illustrated in FIG. 1, corner support assembly 100, hereafter "assembly 100" is configured to reinforce the structural mounting of a metal door (not shown) by receiving and securely mating the door molding 139*a*, 139*b* to a pair of vertical and horizontal frame members 102*a-b*, 118*a-b* in a snap-fit mating relationship. The snap-fit relationship negates the need to notch the door molding 139*a-b* or the frame assemblies 102*a-b*, 118*a-b* for mounting the metal door.

A pair of horizontal and vertical frame members 102*a-b*, 118*a-b* are arranged to join at their ends 116*a-b*, 130*a-b* to form a rectangular shape, which is sized and dimensioned to supportively receive a door frame of the metal door. Horizontal and vertical frame members 118*a-b*, 102*a-b* are defined by multiple guide lines 170*a-b*, 106*a-b* that help with manual fabrication of the metal door.

Additionally, a heavy shear block 136*a-d* provides structural integrity to the assembly 100. Shear block 136*a-d* abuts the intersection of horizontal and vertical frame members 118*a-b*, 102*a-b*, sliding between molding installation grooves 168*a-b* that form in the vertical frame member 102*a-b*. Shear block 136*a-d* and horizontal and vertical frame members 118*a-b*, 102*a-b* are secured into place with multiple fastening means, including at least one of: a shear screw 156*a-f*, a fillet weld 200*a-b*, and a plug weld hole 158. Further, at least one elongated threaded bolt 160*a*, 160*b* passes between the vertical and horizontal frame members 118*a-b* to reinforce the connection therebetween. At least one rubber glass setting block 800*a*-1 rests in the frame members to receive a pane of glass 802 in a secure manner. The metal door may include a commercial aluminum door, with or without a glass pane. Though in other embodiments, any door or gate, metallic or non-metallic, which requires rigid structural support for operation, may also be mated to assembly 100.

Figure 2:
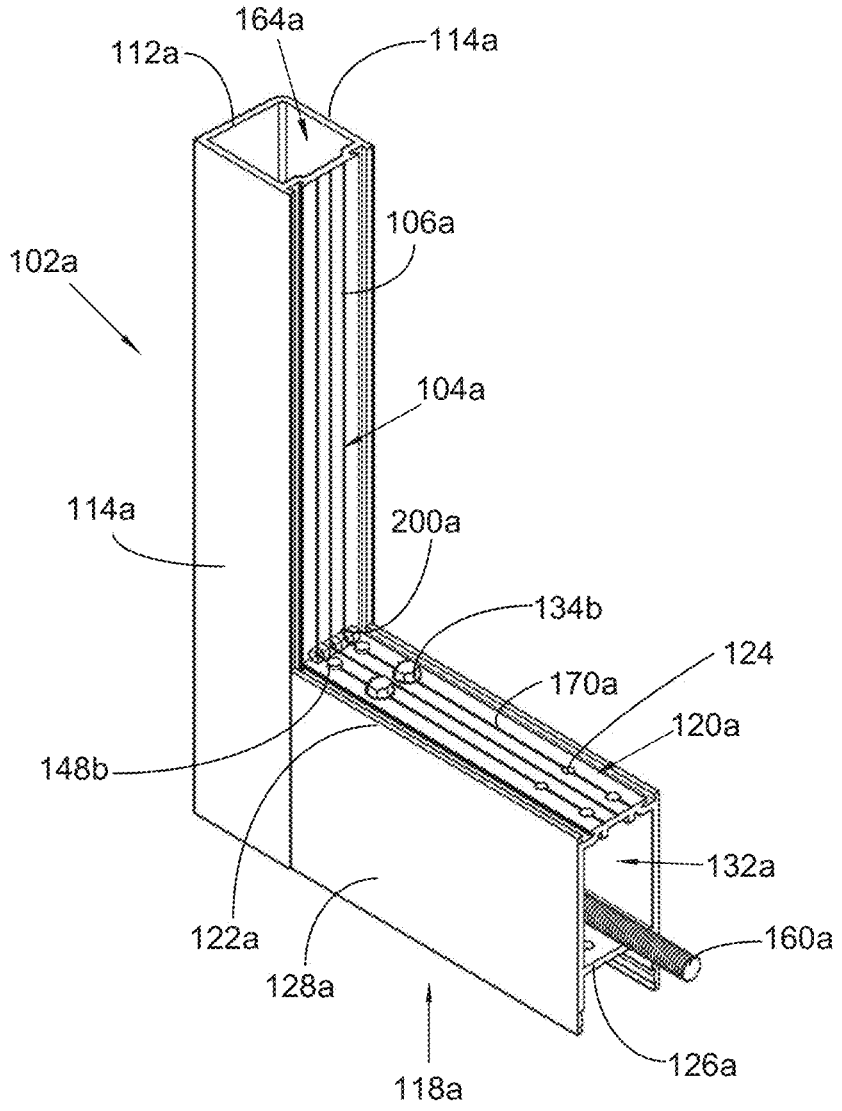
FIG. 2 illustrates a perspective view of an exemplary vertical frame member and horizontal frame member, in accordance with an embodiment of the present invention.

Looking at FIG. 2, assembly 100 includes a pair of vertical frame members 102*a*, 102*b* are disposed in a spaced-apart, parallel relationship, and orient in a generally vertical direction. The vertical orientation of vertical frame members 102*a-b* is parallel with a metal door that mounts the assembly 100. In some embodiments, vertical frame members 102*a-b* comprise a top wall 104*a*, 104*b*, a bottom wall 112*a*, 112*b*, sidewalls 114*a*, 114*b*, and ends 116*a*, 116*b* that define a substantially rectangular cross section passageway extending longitudinally. The vertical frame members 102*a-b* are also defined by an open space 164*a*, 164*b* between the walls 104*a-b*, 112*a-b*, 114*a-b*.

In some embodiments, vertical frame members 102*a-b* comprise extruded aluminum alloy series 6063-T6 temper. Vertical frame members 102*a-b* may also be anodized (AAMA 611—Class 1) to formulate specific colors. The dimensions of vertical frame members 102*a-b* may include, without limitation, 2"×1¾"×⅛"; and 3½"×1¾"×⅛"; and 5"×1¾"×⅛. However in other embodiments, different materials and dimensions may also be used, as assembly 100 is scalable to accommodate variously sized metal doors.

Figure 5A:
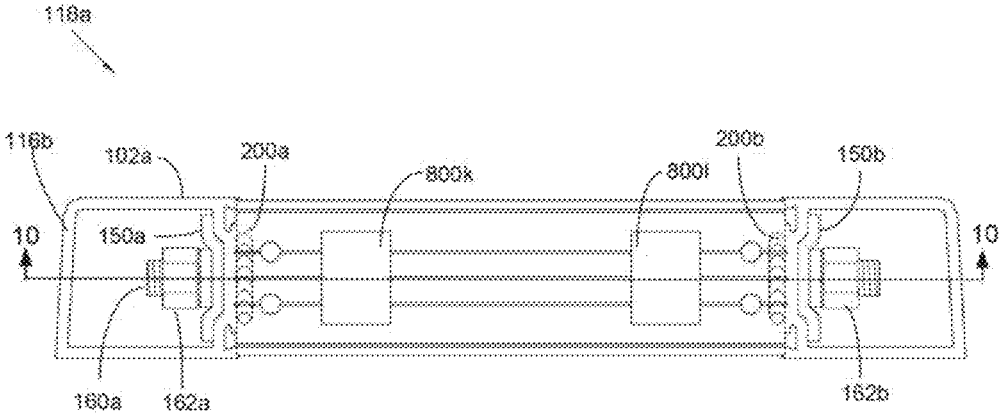
FIGS. 5A and 5B illustrate top views of the horizontal frame member, showing the fastening holes and guide lines, in accordance with an embodiment of the present invention.
Figure 5B:
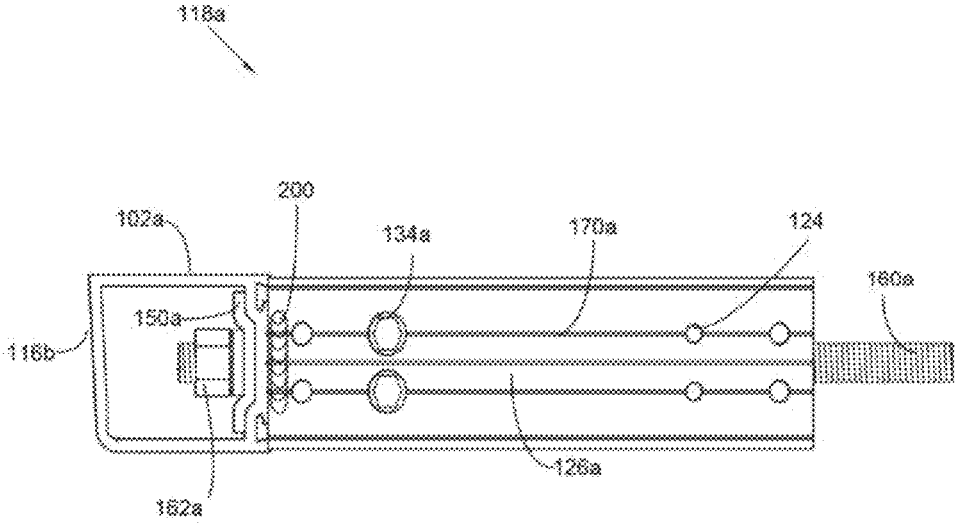

Top wall 104*a-b* of vertical frame members 102*a-b* is defined by multiple vertical molding installation grooves 168*a*, 168*b*. Vertical molding installation grooves 168*a-b* are sized and dimensioned to receive the door molding in a snap-fit mating relationship; thereby negating the need to notch the vertical frame members 102*a-b* or the door molding to create the connection. The top wall 104*a-b* is further defined by a vertical frame bolt hole 108 and a vertical frame fastener hole 110, which are both used to enable passage of various fasteners there through (FIG. 5A).

Figure 3:
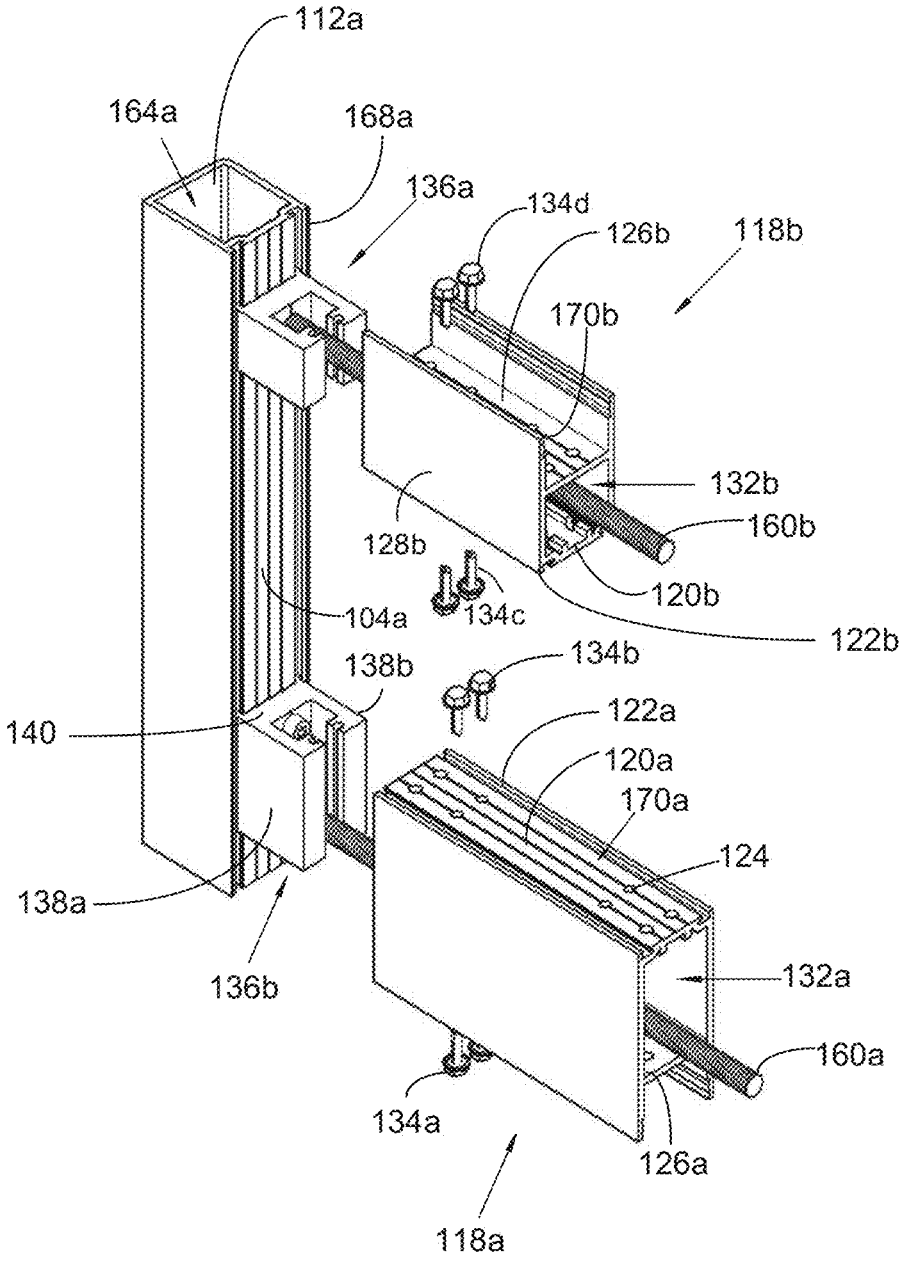
FIG. 3 illustrates a perspective view of the corner support assembly shown in FIG. 1 with both horizontal frame members secured to a vertical frame member with a threaded bolt and shear blocks, in accordance with an embodiment of the present invention.

As FIG. 3 shows, multiple vertical guide lines 106*a-b* are disposed longitudinally along the top wall 104*a-b* of the vertical frame members 102*a-b*. In one non-limiting embodiment, three vertical guidelines 106*a*, 106*b* pass in a parallel relationship across the top wall 104*a-b*. Once aligned with vertical frame members 102*a-b*, the door molding snaps in place, maintain its position freely without any support from the glass pane or an installer. Those skilled in the art will recognize that such a snap-fit mating relationship between door molding and frame members simplifies installation of metal door without the burden of door molding falling out during the glass installation process.

Figure 4:
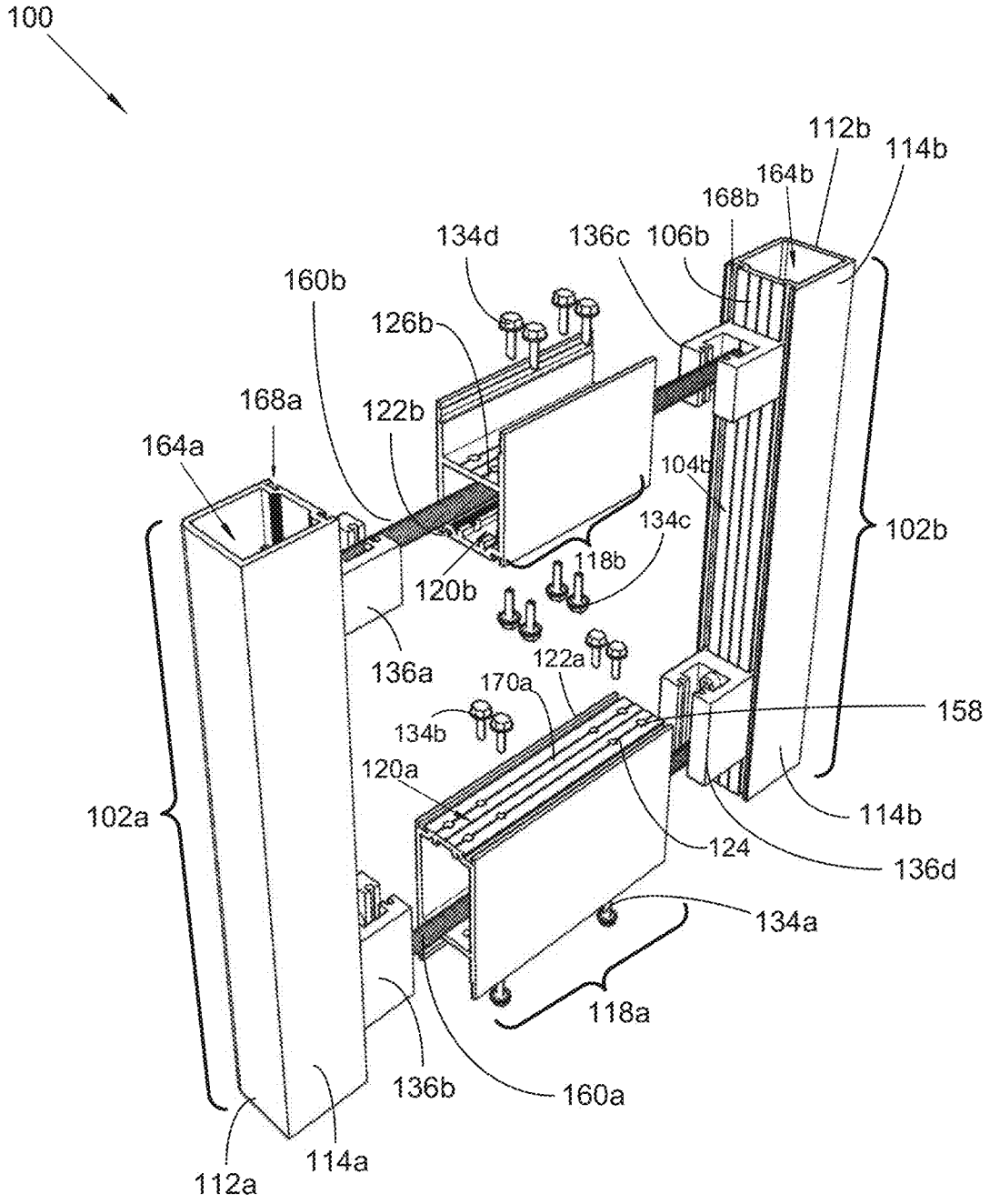
FIG. 4 illustrates a perspective view of all the components of a corner support assembly, showing the frame members separated to enable access to the plate and shear block, and showing the shear screws, plug welds, and threaded bolts used to fasten the door to the assembly, in accordance with an embodiment of the present invention.

Continuing with FIG. 4, assembly 100 also comprises a complimentary pair of horizontal frame members 118*a-b* that join at their ends 130*a*, 130*b* with the vertical frame members 102*a-b* to form a rectangular frame shape. Horizontal frame members 118*a-b* comprise a top wall 120*a*, 120*b*, a bottom wall 126*a*, 126*b*, sidewalls 128*a*, 128*b*, and ends 130*a*, 130*b* defining a substantially rectangular cross section passageway extending longitudinally. Horizontal frame members 118*a-b* are also defined by an open space 132*a*, 132*b* between the walls. A threaded bolt 160*a*, 160*b*, described below passes through open space 132*a-b* to secure door to frame members 102*a-b*, 118*a-b*. In some embodiments, horizontal frame members 118*a-b* are extruded aluminum alloy series 6063-T6 temper. Horizontal frame members 118*a-b* may be anodized (AAMA 611—Class 1) to formulate specific colors.

Looking at FIG. 1 top wall 120*a-b* of horizontal frame members 118*a-b* is defined by multiple horizontal molding installation grooves 122*a-b*. Horizontal molding installation grooves 122*a-b* receive the door molding in a snap-fit mating relationship; thereby negating the need to notch the frame member or the door molding to create the connection. Top wall 120*a-b* is further defined by at least one self-tapping fastening hole 124, which is used to enable passage of at least one self-tapping screw 134*a-h* (See also FIG. 5B).

In some embodiments, multiple horizontal guide lines 170*a*, 170*b* are disposed longitudinally along the top wall of horizontal frame members 118*a-b*. In one non-limiting embodiment, three horizontal guidelines pass in a parallel relationship across the top wall 120*a-b*.

Figure 6:
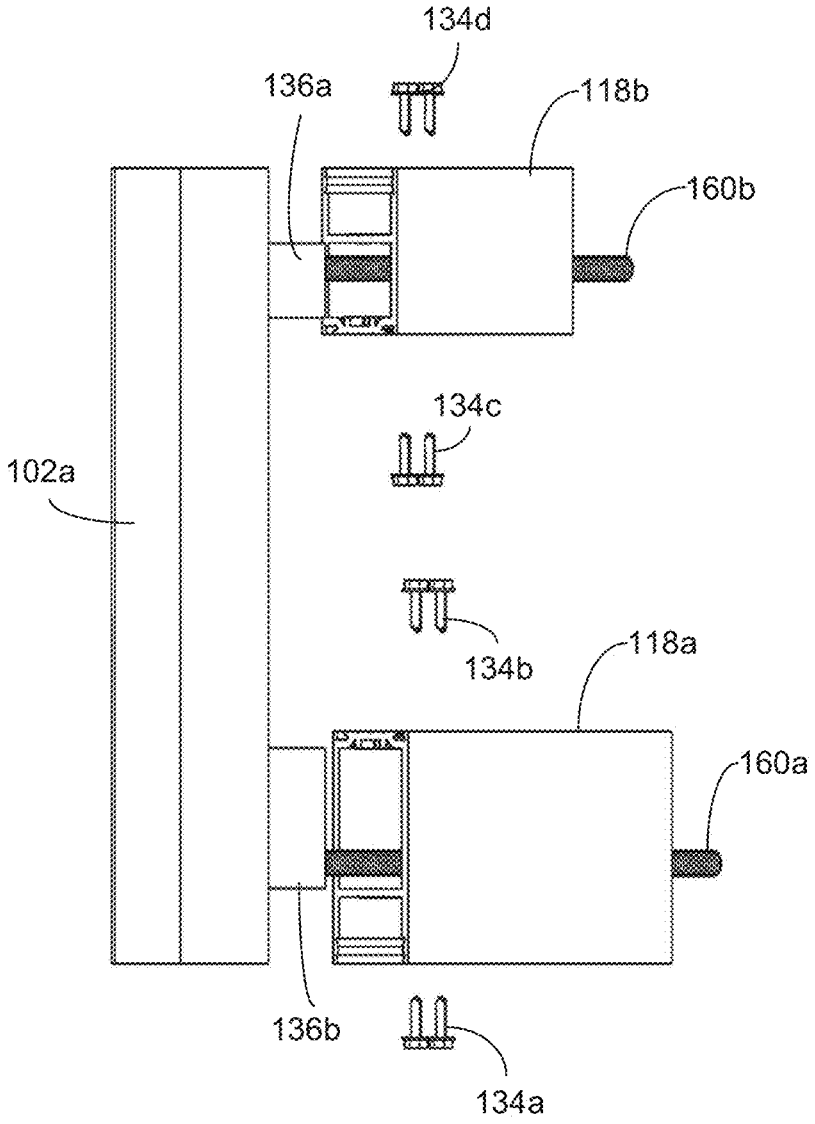
FIG. 6 illustrates the corner support assembly, in accordance with an embodiment of the present invention.
Figure 7:
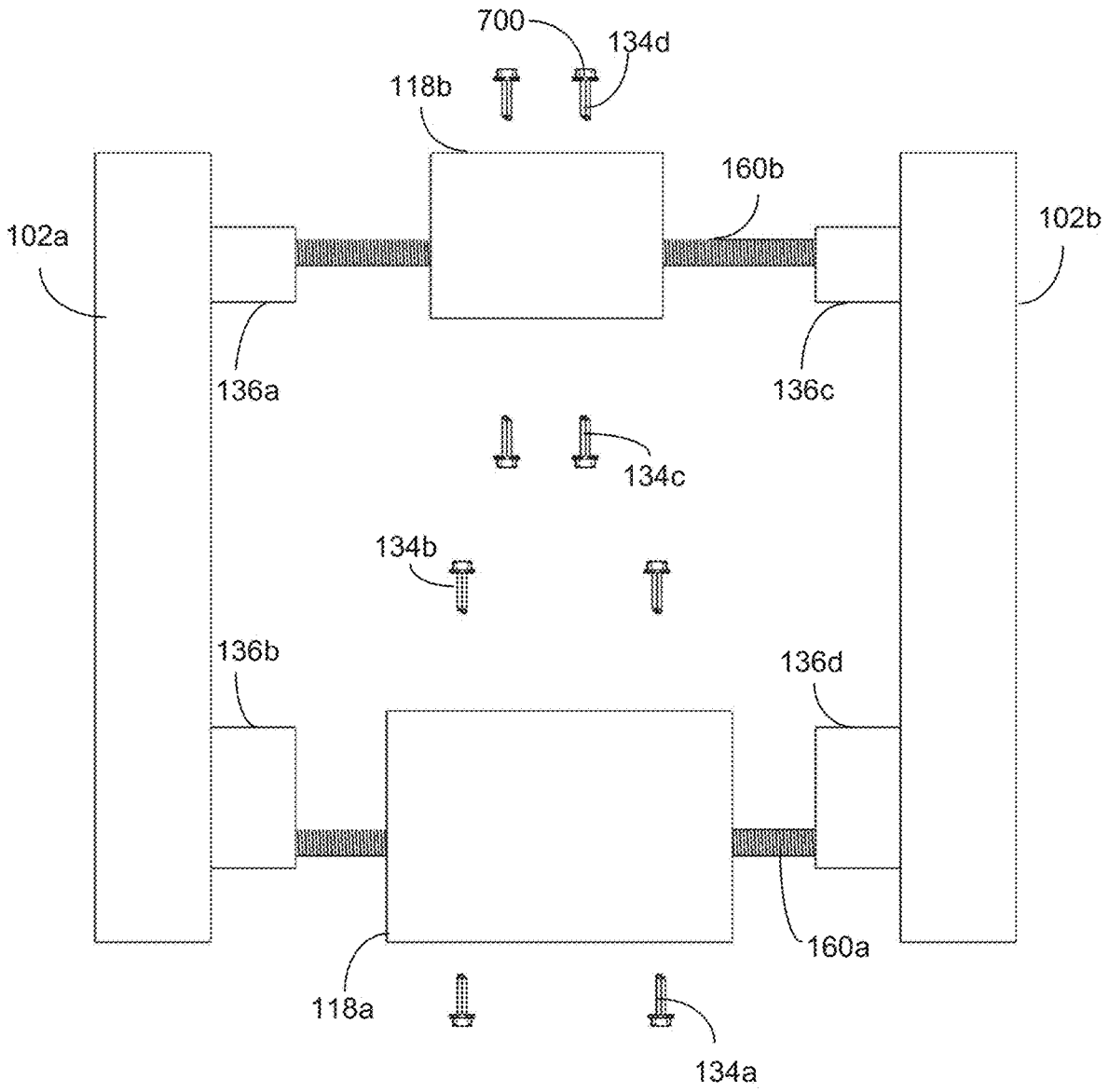
FIG. 7 illustrates the corner support assembly, in accordance with an embodiment of the present invention.

As FIG. 6 illustrates, assembly 100 provides at least one self-tapping screw 134*a-h*. Self-tapping screw 134*a*, 134*b*, 134*c*, 134*d*, 134*e*, 134*f*, 134*g*, 134*h* is configured to pass through opposing sides of horizontal frame members 118*a*, 118*b*, and a door frame (not shown). Self-tapping screw 134*a-d* helps to fasten the door frame to the horizontal and vertical frame members 118*a-b*, 102*a-b* (FIG. 7). In one non-limiting embodiment, the self-tapping screw 134*a-d* comprises a #10—16×¾" self-tapping hex washer head zinc plated steel screw. Though in other embodiments, other screw/bolt/washer/nut fastening mechanisms may also be used.

Looking again at FIG. 3, assembly 100 provides at least one shear block 136*a-d*. Shear block 136*a-d* is defined by a U-shaped cross section. Though in other embodiments, different shapes are possible. Shear block 136*a-d* is configured to enhance the structural integrity and resisting lateral and shearing forces against the metal door. Specifically, shear block 136*a-d* securely abuts at the intersection of horizontal and vertical frame members 102*a-b* to prevent sliding or collapsing thereof. In one non-limiting embodiment, two shear blocks 136*a*, 136*b* attach to vertical frame member 102*a*; and two shear blocks 136*c*, 136*d* attach to vertical frame member 102*b*.

Looking ahead to FIG. 1, shear block 136*a-d* comprises a pair of shear walls 138*a*, 138*b* and an abutment wall 140. Abutment wall 140 abuts the top wall 104*a-b* of vertical frame members 102*a-b*. In one embodiment, abutment wall 140 is defined by a pair of rails 142*a*, 142*b* that are configured to slide between the vertical molding installation grooves 168*a-b* in vertical frame members 102*a-b*. Abutment wall 140 is further defined by a shear fastener hole 144, a shear bolt 146, and a shear plug weld hole 148. Shear walls form a pair of shear vertical fastening holes 137 used to secure shear block to horizontal frame members.

As discussed above, the assembly 100 is configured to securely retain a metal door within the horizontal and vertical frame members 118*a-b*, 102*a-b*. Thus, in one possible embodiment, at least one fillet weld 200*a*, 200*b* is applied at the intersection of the shear block 136*a-d*, the vertical frame member 102*a-b*, and the horizontal frame member 118*a-b*. Fillet weld 200*a-b* holds frame members 102*a-b*, 118*a-b* at a perpendicular to each other. Fillet weld 200*a-b* may have a length up to 1⅛". Though in other embodiments, other weld lengths are possible.

As illustrated back in FIG. 1, assembly 100 provides a plate 150*a*, 150*b* that helps stabilize the abutment between shear block 136*a-d* and vertical frame member 102*a-b*. Plate 150*a-b* is disposed to position behind abutment wall 140 of shear block 136*a-d*, and top wall 104*a-b* of vertical frame members 102*a-b*. Plate 150*a-b* is defined by a plate fastener hole 152 and a plate bolt 154 that enable passage there through. In one non-limiting embodiment, the plate 150*a-b* comprises a zinc plated steel mounting plate.

Figure 10A:
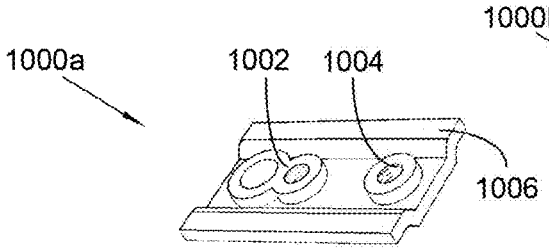
FIGS. 10A and 10B illustrate perspective view of the mounting plates, in accordance with an embodiment of the present invention.
Figure 10B:
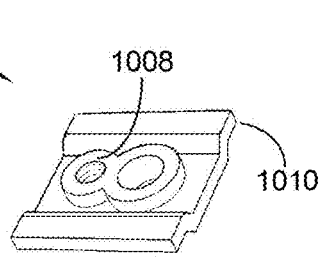

FIGS. 10A and 10B illustrate two exemplary mount plates 1000*a*, 1000*b* having a unique configuration that abut the inside surface of the top wall of the vertical members with wings that further strengthen the assembling. A long mount plate 1000*a* forms a wing 1006 and includes plate threaded fastener hole 1002 and another plated threaded fastener hole 1004, so as to help grip the shear block. A short mount plate 1000*b* forms a wing 1010, and includes a plate threaded fastener hole 1008 for gripping the shear blocks 136*a-d* (See FIG. 11).

The difference in plate lengths is engineered per the horizontal members top wall and bottom wall to provide a more stern compression of the horizontal members between the vertical members. The plate threaded fastener holes 1002, 1008 protrude ⅛" at the rear of the plate beyond the plate's ⅛" thickness to ensure further fastening strength between the plate and the shear screw. The plate bolt hole also protrudes ⅛" at the rear to provide proper mechanical operation for the tightening of the nut and also strengthens the integrity of the plates 1000*a*, 1000*b*.

In some embodiments, at least one shear screw 156*a-f* passes through shear fastener hole 144 and the plate fastener hole 152. In one embodiment, two shear screws 156*a*, 156*b*, 156*c*, 156*d*, 156*e*, 156*f* pass through each side of shear blocks 136*a*, 136*b*, 136*c*, 136*d*. Shear screw 156*a-f* helps fasten shear block 136*a-d* to vertical frame member 102*a-b* and/or horizontal frame member 118*a*, 118*b*. In one non-limiting embodiment, shear screw 156*a-f* comprises a ¼"-20×1" zinc plated stainless steel socket cap head screw. Though in other embodiments, different dimensions are possible. And other screw/bolt/washer/nut fastening mechanisms may also be used.

In addition to shear screw 156*a-f*, another fastening means for securing shear block 136*a-d* is at least one plug weld hole 158 (FIG. 4). At least one plug weld hole 158 is applied at multiple plug welds 148*a*, 148*b*, 148*c*, 148*d*, 148*e*, 148*f*, 148*g*, 148*h* that in corresponding shear blocks 136*a-d*. Plug weld hole 158 and shear plug weld hole 148 is designed to help fasten shear block 136*a-d* to horizontal frame member. Similar to fillet weld 200*a-b*, the plug weld hole 158 and shear plug weld hole 148 provides a welding fastening means, in addition to screws and bolts.

Turning now to FIG. 7, assembly 100 provides at least one elongated threaded bolt 160*a*, 160*b* that extends between the top wall of vertical frame members 102*a-b*, through open space 132*a-b* of horizontal frame members 118*a-b*. In one non-limiting embodiment, the ends of threaded bolt 160*a*, 160*b* pass through plate bolt hole 154 and shear bolt hole 146, so as to sandwich the vertical frame, plate 150*a-b*, and horizontal frame member securely together.

Figure 11:
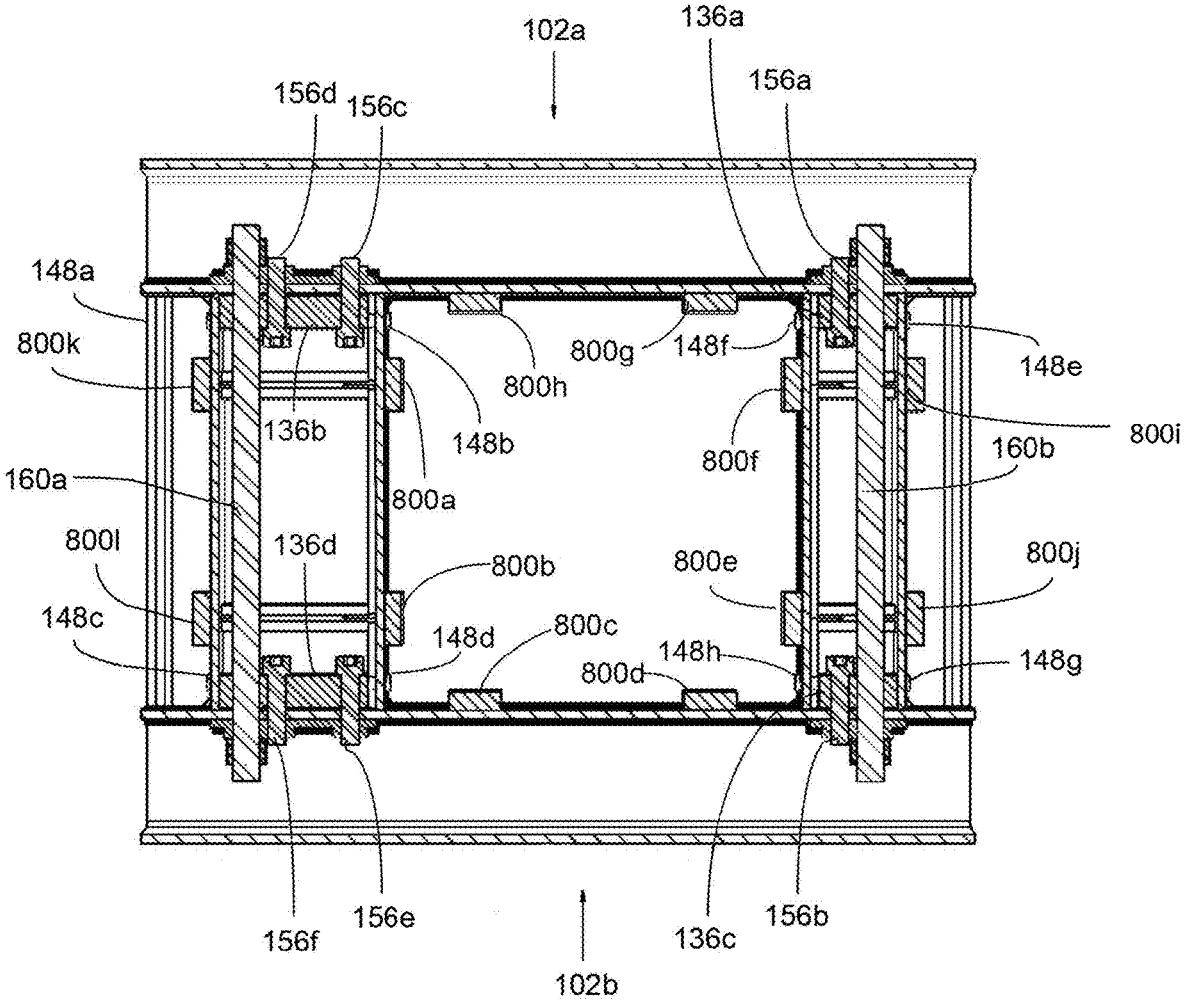
FIG. 11 illustrates a sectioned top view of the corner support assembly according to section 10 of FIG. 5A, in accordance with an embodiment of the present invention.

Further, as shown in FIG. 11, threaded bolt 160*a*, 160*b* helps fasten vertical frame members 102*a-b* to horizontal frame members 118*a-b*, providing lateral stability along horizontal frame members 118*a-b*. In one non-limiting embodiment, threaded bolt 160*a-b* comprises a ⅜" zinc plated steel threaded rod. In some embodiments, at least one bolt nut 162*a*, 162*b* mates with threaded bolt 160*a*, 160*b* to tighten the plate 150*a-b* to vertical frame member 102*a-b*. In one non-limiting embodiment, bolt nut 162*a-b* comprises a ⅜"-16 zinc plated steel nut. Though in other embodiments, other screw/bolt/washer/nut fastening mechanisms may also be used.

In one embodiment the metal door can fasten to the frame members 102*a-b*, 118*a-b* through shear block 136*a-d* and threaded bolt 160*a-b*. In another embodiment, metal door can fasten to frame members 102*a-b*, 118*a-b* through shear block 136*a-d* and self-tapping screws 134*a-d*. In yet another embodiment, metal door can fasten to frame members 102*a-b*, 118*a-b* through shear block 136*a-d*, fillet weld 200*a-b*, and plug weld hole 158. Thus metal door may be fastened by only one, two, or all three fastening means.

Figure 8:
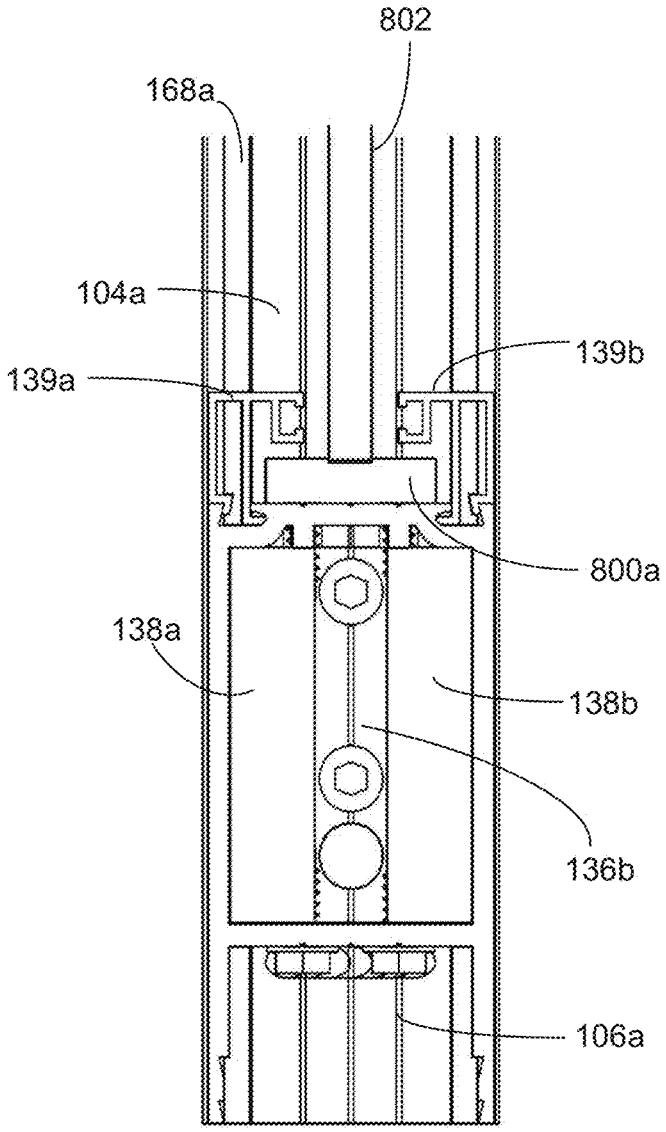
FIG. 8 illustrates a top view of the horizontal frame member with a glass setting block positioned therein and receiving a pane of glass, in accordance with an embodiment of the present invention.

Looking now at FIG. 8, assembly 100 provides a unique component for securely retaining a pane of glass 802 from metal door, or independently thereof. The at least one glass setting block 800*a*, 800*b*, 800*c*, 800*d*, 800*e*, 800*f*, 800*g*, 800*h*, 800*i*, 800*j*, 800*k*, 8001 is configured with a channel that is sized and dimensioned to receive a pane of glass 802. Those skilled in the art will recognize that such a snap-fit mating relationship between door molding and frame members, along with glass setting block to receive glass pane, works to simplify the installation of metal door without the burden of door molding falling out during the glass installation process.

Figure 9:
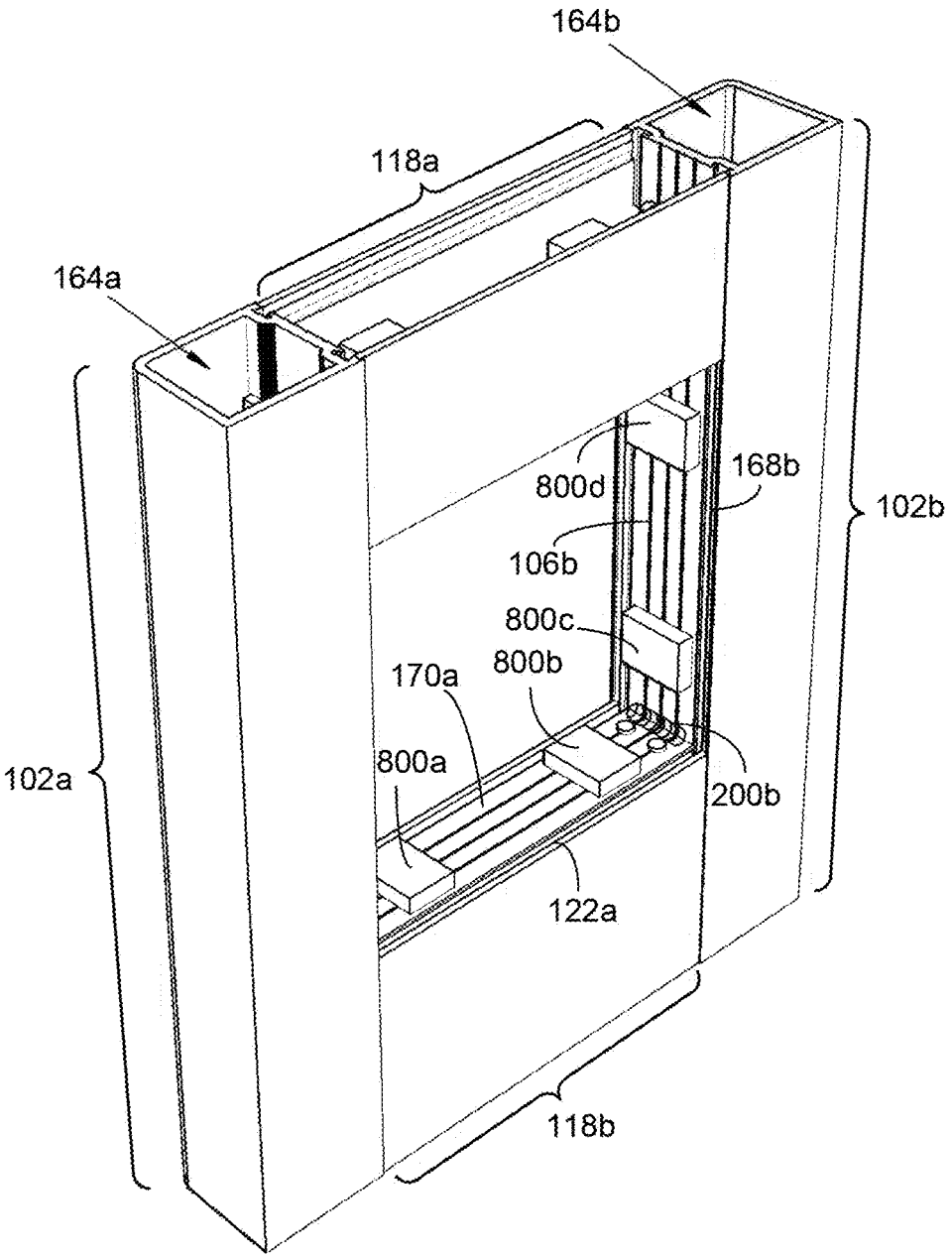
FIG. 9 illustrates a perspective view of the corner support assembly for metal framed doors, in accordance with an embodiment of the present invention.

Turning now to FIG. 9, glass setting block 800*a*-1 rests on the top wall of horizontal frame members 118*a-b* and vertical frame members 102*a-b*. The pane of glass 802 may include a ¼" or a 1" pane of glass. In other embodiments, glass setting block 800*a*-1 has dimensions of about ¾"×1"×¼". In yet other embodiments, glass setting block 800*a*-1 comprises an adhesive 700 that is applied over the at least one self-tapping screw 134*a-h*.

Figure 12A:
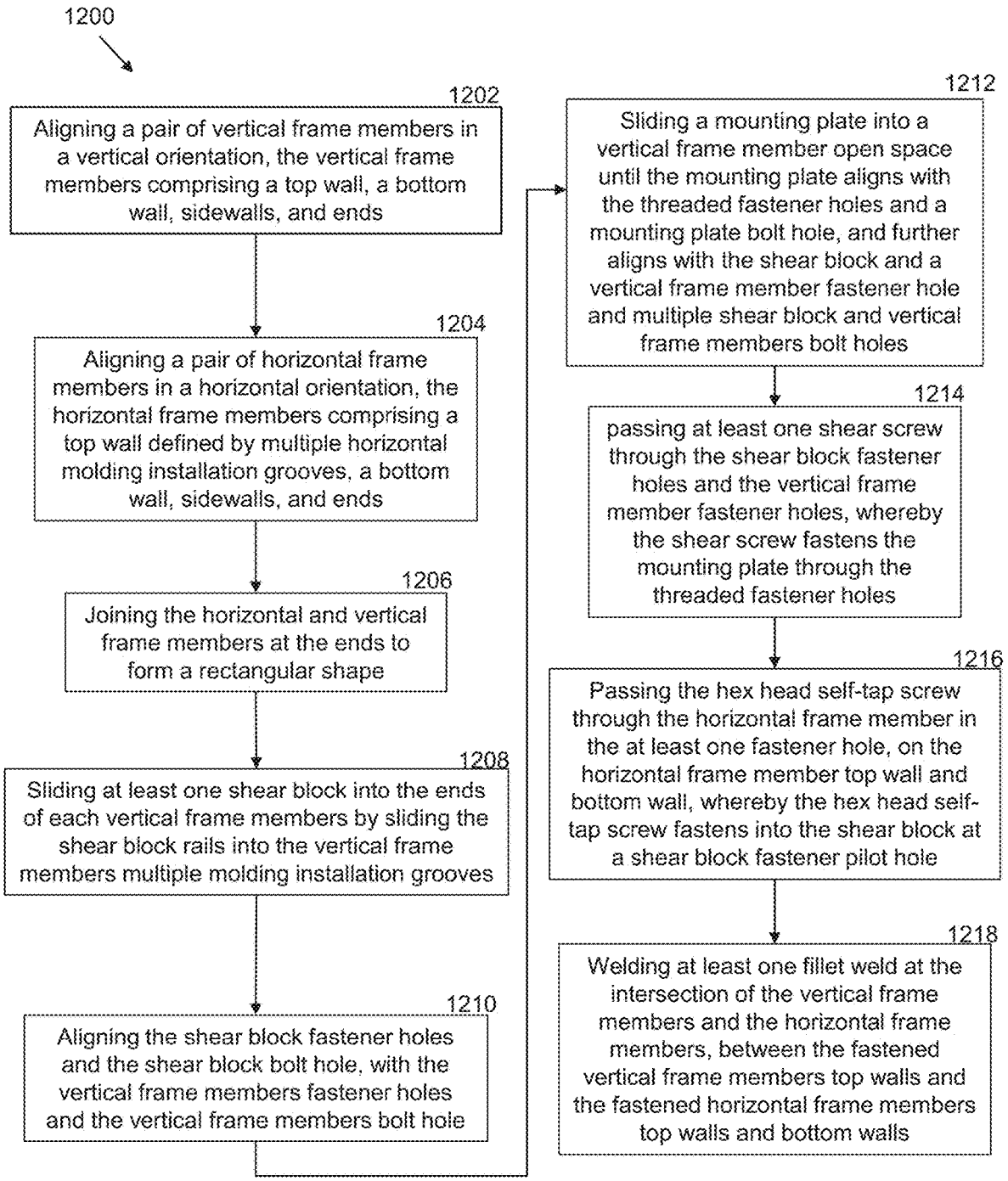
FIGS. 12A and 12B illustrate a flowchart for an exemplary method for installing a corner door assembly, in accordance with an embodiment of the present invention.
Figure 12B:
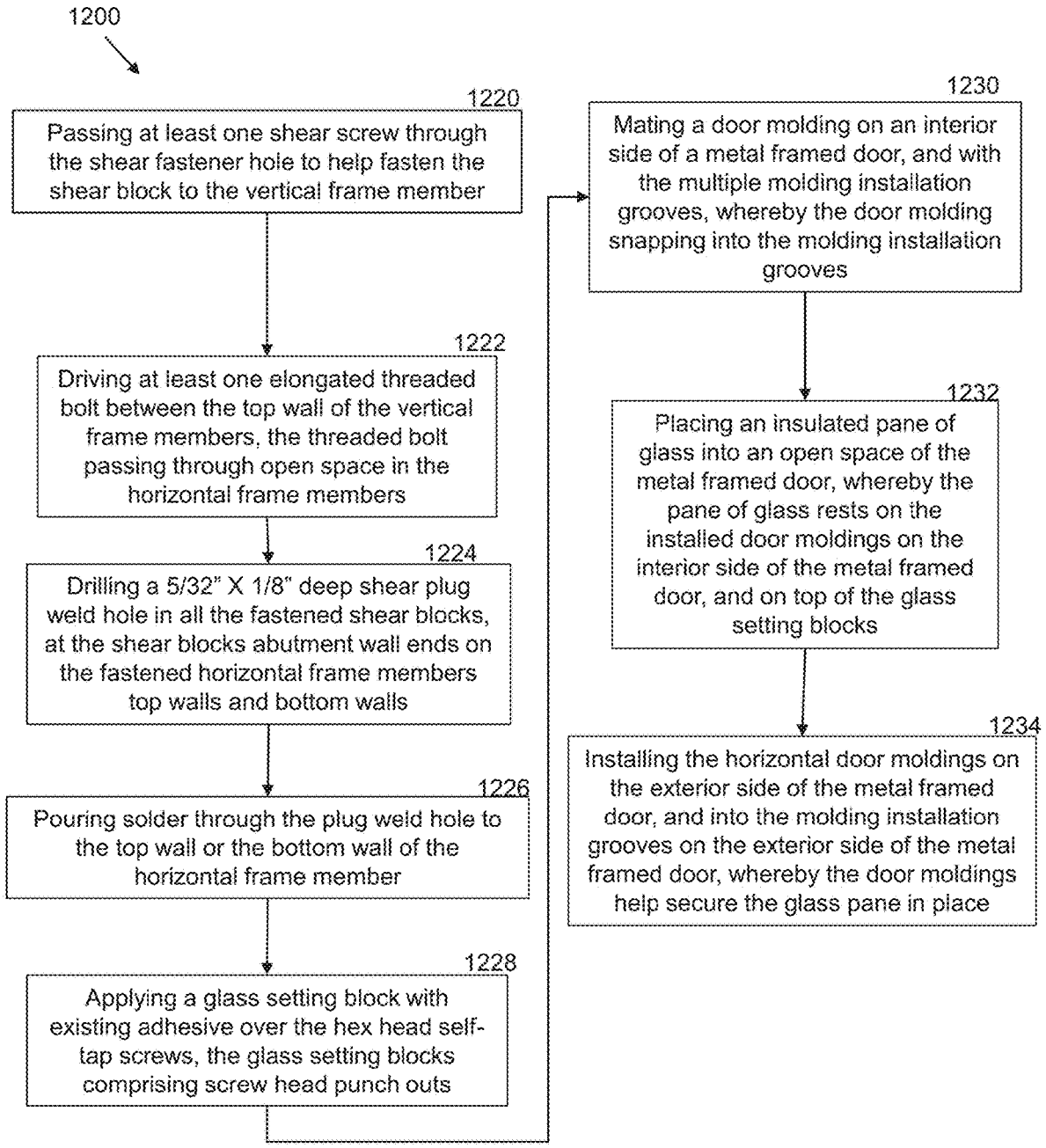

FIGS. 12A and 12B illustrate an exemplary method 1200 for installing a corner door assembly. The assembly 100 is installed by aligning and fastening vertical and horizontal frame members, and then securing the alignments with various screws, elongated threaded bolts fillet welds, and plug hole welds. The present invention is unique in that the surfaces, niches, and grooves that form in the horizontal and vertical frame members are configured to enable easy sliding and snap fit action with each other, with shear blocks, glass pane, and with door molding. In some embodiments, the method 1200 may include an initial Step 1202 of aligning a pair of vertical frame members in a vertical orientation, the vertical frame members comprising a top wall, a bottom wall, sidewalls, and ends. This is generally in an upright position.

After the vertical frame members are spaced apart to the desired width, the method 1200 further includes a Step 1204 of aligning a pair of horizontal frame members in a horizontal orientation, the horizontal frame members comprising a top wall defined by multiple horizontal molding installation grooves, a bottom wall, sidewalls, and ends. At this point, the horizontal and vertical frame members form a generally rectangular shape that is sized and dimensioned to receive a metal door. A Step 1206 includes joining the horizontal and vertical frame members at the ends to form a rectangular shape. This is not a permanent fastening, but a temporary one until the appropriate screws, bolts, and welds are applied.

In some embodiments, a Step 1208 comprises sliding at least one shear block into the ends of each vertical frame members by sliding the shear block rails into the vertical frame members multiple molding installation grooves. The shear blocks slide in, at the ends of each vertical frame members by sliding the shear block rails into the vertical frame members multiple molding installation grooves. With the at least one shear block abutting the top wall of all the vertical frame members at all ends, the shear block aligns with #1 or #2 fastener holes and the shear block bolt hole. The shear block also aligns with the vertical frame members #1 or #2 fastener holes and the vertical frame members bolt hole. At this point all four of the shear blocks are secured in place.

Now to achieve a more precise fastening the vertical and horizontal frame members, a Step 1210 includes aligning the shear block fastener holes and the shear block bolt hole, with the vertical frame members fastener holes and the vertical frame members bolt hole. Then, in some embodiments, a Step 1212 may include sliding a mounting plate into a vertical frame member open space until the mounting plate aligns with the threaded fastener holes and a mounting plate bolt hole, and further aligns with the shear block and a vertical frame member fastener hole and multiple shear block and vertical frame members bolt holes. The mounting plate may include a flat, rigid Zinc plated metal mountain plate. Though in other embodiments different kinds of metals and plates can be.

In beginning to fasten the components, a Step 1214 comprises passing at least one shear screw through the shear block fastener holes and the vertical frame member fastener holes, whereby the shear screw fastens the mounting plate through the threaded fastener holes. The method 1200 may further comprise a Step 1216 of passing the hex head self-tap screw through the horizontal frame member in the at least one fastener hole, on the horizontal frame member top wall and bottom wall, whereby the hex head self-tap screw fastens into the shear block at a shear block fastener pilot hole. The hex head self-tap screw is the type of screw that does not need a nut or a washer. Thus, this is effective for passing through the horizontal frame member fastener holes.

Continuing with the assemblage, a Step 1218 includes welding at least one fillet weld at the intersection of the vertical frame members and the horizontal frame members, between the fastened vertical frame members top walls and the fastened horizontal frame members top walls and bottom walls. The fillet weld provides a very secure fastening mechanism between the horizontal and vertical frame members, creating both lateral and axial stability. The 1⅛" fillet weld welding all fastened vertical frame members to all fastened horizontal frame members. A Step 1220 includes passing at least one shear screw through the shear fastener hole to help fasten the shear block to the vertical frame member. This process is now done for all shear blocks, fastening each shear block to the vertical frame member top wall on each end of both vertical frame members. This creates the attachment of the shear block to the vertical frame member.

The method 1200 may further comprise a Step 1222 of driving at least one elongated threaded bolt between the top wall of the vertical frame members, the threaded bolt passing through open space in the horizontal frame members. The threaded bolt is elongated, and sufficiently rigid to create a solid lateral fastening mechanism for the corner door assembly 100. The threaded bolt may include a ⅜" zinc plated steel threaded rod.

The threaded bolt passes through one of the shear block bolt hole, and then through the vertical frame member bolt hole. The threaded bolt also passes through the zinc plated steel mounting plate bolt hole, extending one end of the ⅜" zinc plated threaded rod into the vertical frame member open space, approximately 1" beyond the vertical frame member top wall. A bolt nut is then attached to one end of the vertical frame members open space, at the same end of the vertical frame member with the ⅜" zinc plated steel threaded rod. The bolt nut mates with the ⅜" zinc plated steel threaded rod.

The assemblage requires taking the opposite end of the same ⅜" zinc plated steel threaded rod, and placing the other end of the same ⅜" zinc plated steel threaded rod through. The threaded rod is to pass through one end of the horizontal frame member open space, and out the other end of the horizontal frame member open space. At this point one end of the same horizontal frame member is placed on the vertical frame member top wall, by passing the already fastened shear block thru the horizontal frame member open space, and butting the one end of the same horizontal frame member with the top wall of the vertical frame member. The fastened shear block fastener pilot holes are aligned with the horizontal frame member fastener holes. This process is repeated at the opposite end of the same vertical frame member.

The same vertical frame member fastens to both horizontal frame members at the aligned ends, with at least one hex head self-tap screw. The at least one hex head self-tap screw goes through the horizontal frame member at the at least one fastener hole, on the horizontal frame member top wall and bottom wall. The hex head self-tap screw also fastens into the shear block at the shear block fastener pilot hole. The hex head self-tap screw fastens the horizontal frame members with the fastened shear blocks at the aligned ends.

Next, the opposite end of the ⅜" zinc plated steel threaded rods are positioned between the shear walls of the already fastened shear block on the other vertical frame member. Upon resting both the ⅜" zinc plated steel threaded rods other ends in between the shear blocks shear walls, the shear blocks are guided on the other vertical frame member, into both horizontal frame members open space, on each other ends of both horizontal frame members. They are guided in a way that disposes the shear blocks half way into the horizontal frame members open space.

Then, one of the other ends of one of the ⅜" zinc plated threaded rods is guided through the fastened shear block bolt hole. The ⅜" zinc plated threaded rod then passes through the other vertical frame members bolt hole, and lastly through the zinc plated steel mounting plate bolt hole and into the other vertical frame members open space, extending one of the ⅜" zinc plated steel threaded rods other end, approximately 1" beyond the top wall of the other vertical frame member.

In doing so the other ends of one of the horizontal frame member are aligned with the top wall of the vertical frame member, aligning the at least one fastener hole, on the other end of the horizontal frame member, with the at least one shear block fastener pilot hole of the fastened shear block. In doing so the other end of the horizontal frame member butts with the top wall of the other vertical frame member, at the corner where the other end of one of the ⅜" zinc plated steel threaded rods is in the other vertical frame members open space. A bolt nut is then placed in the other vertical frame members open space, mating the bolt nut with the ⅜" zinc plated steel threaded rod, at the corner where the other end of the one of the ⅜" zinc plated steel threaded rods in the other vertical frame member's open space. Here, the bolt nut is tightened lightly.

The same process is repeated on the other end of the same other vertical frame member. Then all bolt nuts are tightened in all the vertical frame member's open space, fastening all vertical frame members to all horizontal frame members. The hex head self-tap screw then passed through the fastener hole, on the top wall and bottom wall of the other ends of both horizontal frame members. The hex head self-tap screw fastens into the already fastened shear blocks, shear block fastener pilot holes on the other vertical frame member, fastening both horizontal frame members other ends to the already fastened shear blocks.

In some embodiments, a Step 1224 includes drilling a 5/32×⅛" deep shear plug weld hole in all the fastened shear blocks, at the shear blocks abutment wall ends on the fastened horizontal frame members top walls and bottom walls. A Step 1226 comprises pouring solder through the plug weld hole to the top wall or the bottom wall of the horizontal frame member. This process is now done at all of at least one 7/32" plug weld holes on all fastened horizontal frame members top walls and bottom walls, welding all fastened horizontal frame members with all the fastened shear blocks.

A Step 1228 includes applying a glass setting block with existing adhesive over the hex head self-tap screws, the glass setting blocks comprising screw head punch outs. Upon applying all glass setting blocks with existing adhesive over all hex head self-tap screw heads, on all the fastened horizontal frame members top walls and bottom walls and all the fastened vertical frame members top walls. The glass setting block with existing adhesive is applied on all the fastened vertical frame members top walls, measuring up about 1" from all fastened horizontal frame member's top walls with the measuring ending at the beginning edge of the glass setting block with existing adhesive. At this point, all the glass setting blocks are applied to all the fastened horizontal frame members bottom walls. And all the glass setting blocks are applied to the fastened horizontal frame members top walls, and all the fastened vertical frame members top walls.

In some embodiments, a Step 1230 may include mating a door molding on an interior side of a metal framed door, and with the multiple molding installation grooves, whereby the door molding snapping into the molding installation grooves. The horizontal door moldings are installed on the interior side of the metal framed door into the multiple molding installation grooves first. Then the vertical door moldings are installed on the interior side of the metal framed door into the multiple molding installation grooves, upon installing all the door moldings on the interior side of the metal framed door. A Step 1232 may include placing an insulated pane of glass into an open space of the metal framed door, whereby the pane of glass rests on the installed door moldings on the interior side of the metal framed door, and on top of the glass setting blocks.

A final Step 1234 comprises installing the horizontal door moldings on the exterior side of the metal framed door, and into the molding installation grooves on the exterior side of the metal framed door, whereby the door moldings help secure the glass pane in place. Then the vertical door moldings are installed, on the exterior side of the metal framed door, into the multiple molding installation grooves on the exterior side of the metal framed door. At least one glass setting block **800*i*, 800*j*** rests on the exterior side of the door. At this point in the assemblage, all the installed door moldings are fully securing the glass pane within the metal framed door open space.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A corner support assembly for a metal framed door, the assembly comprising:

a pair of vertical frame members comprising a top wall defined by multiple vertical molding installation grooves, a vertical frame bolt hole, and a vertical frame fastener hole, the vertical frame members further comprising a bottom wall, sidewalls, and ends defining a substantially rectangular cross section passageway extending longitudinally, the vertical frame members further being defined by an open space between the walls;

a pair of horizontal frame members comprising a top wall defined by multiple horizontal molding installation grooves and at least one self-tapping fastening hole, a bottom wall, sidewalls, and ends defining a substantially rectangular cross section passageway extending longitudinally, the horizontal frame members further being defined by an open space between the walls, the horizontal and vertical frame members joining at respective ends;

at least one self-tapping screw operable to pass through the horizontal frame members, the vertical frame members, and a door frame, the self-tapping screw helping to fasten the door frame to the horizontal frame members;

at least one shear block comprising a pair of shear walls and an abutment wall, the abutment wall abutting the top wall of the vertical frame members, the abutment wall defined by a pair of rails, whereby the rails are slidably displaceable to position between the vertical molding installation grooves, the abutment wall further being defined by a shear fastener hole, a shear bolt hole, the shear walls forming a pair of shear vertical fastening holes;

at least one fillet weld at an intersection of the vertical frame members and the horizontal frame members;

a plate disposed adjacent to top wall of the vertical frame members, the plate being defined by a plate fastener hole and a plate bolt hole;

at least one shear screw passing through the shear fastener hole and the plate fastener hole, the shear screw helping to fasten the shear block to the vertical frame member;

at least one plug weld, the plug weld forming a plug weld hole, the plug weld helping to fasten the shear block to the horizontal frame member; and at least one elongated threaded bolt extending between the top wall of the vertical frame members, the threaded bolt passing through an open space in the horizontal frame members, the threaded bolt further passing through the shear bolt hole, the vertical frame bolt hole and the plate bolt hole, the threaded bolt helping to fasten the horizontal and vertical frame members together.

2. The assembly of claim 1, wherein the horizontal and vertical frame members are extruded.

3. The assembly of claim 1, wherein the vertical frame members include at least one of the following dimensions: 2 inches×1¾ inches×⅛ inch, 3½ inches×1¾ inches×⅛ inch, and 5 inches×1¾ inches×⅛ inch.

4. The assembly of claim 1, wherein the threaded bolt comprises a ⅜" zinc plated steel threaded rod.

5. The assembly of claim 1, wherein the bolt nut comprises a ⅜ inch-16 zinc plated nut.

6. The assembly of claim 1, wherein the shear screw comprises a ¼ inch-20×1 inch zinc plated stainless steel socket cap head screw.

7. The assembly of claim 1, wherein the plate comprises a zinc plated steel mounting plate.

8. The assembly of claim 1, wherein the plug weld comprises a 7/32" plug weld.

9. The assembly of claim 1, wherein the at least one fillet weld has a length up to 1⅛ inches.

10. The assembly of claim 1, wherein the self-tapping screw comprises a #10-16×¾ inch self-tapping hex washer head zinc plated steel screw.

11. The assembly of claim 1, wherein the door frame supports a ¼ inch or a 1 inch insulated pane of glass.

12. The assembly of claim 11, further comprising at least one glass setting block operable to receive the insulated pane of glass, the glass setting block resting on the top wall of the horizontal frame members and the vertical frame members.

13. The assembly of claim 12, wherein the glass setting block is defined by a height of ¾ inch, a width of 1 inch, and a length of ¼ inch.

14. The assembly of claim 13, wherein the glass setting block comprises an adhesive applied over the at least one self-tapping screw.

15. The assembly of claim 1, further comprising at least one bolt nut, the bolt nut mating with the threaded bolt.

16. The assembly of claim 1, further comprising three horizontal guide lines disposed longitudinally along the top wall of the horizontal frame members.

17. The assembly of claim 1, further comprising three vertical guide lines disposed longitudinally along the top wall of the vertical frame members.

18. The assembly of claim 1, wherein the door frame supports a metal door.

19. A corner support assembly for a metal framed door, the assembly comprising:

a pair of vertical frame members comprising a top wall defined by multiple vertical molding installation grooves, a vertical frame bolt hole, and a vertical frame fastener hole, the vertical frame members further comprising a bottom wall, sidewalls, and ends defining a substantially rectangular cross section passageway extending longitudinally, the vertical frame members further being defined by an open space between the walls;

multiple vertical guide lines disposed longitudinally along the top wall of the vertical frame members;

a pair of horizontal frame members comprising a top wall defined by multiple horizontal molding installation grooves and at least one self-tapping fastening hole, a bottom wall, sidewalls, and ends defining a substantially rectangular cross section passageway extending longitudinally, the horizontal frame members further being defined by an open space between the walls, the horizontal and vertical frame members joining at the ends to form a rectangular shape;

multiple horizontal guide lines disposed longitudinally along the top wall of the horizontal frame members;

at least one self-tapping screw operable to pass through the top wall of the horizontal frame members, the bottom wall of the horizontal frame members, and a door frame, the self-tapping screw helping to fasten the door frame to the horizontal frame members;

at least one shear block defined by a U-shaped cross section, the shear block comprising a pair of shear walls and an abutment wall, the abutment wall abutting the top wall of the vertical frame members, the abutment wall defined by a pair of rails, whereby the rails are slidably displaceable to position between the vertical molding installation grooves, the abutment wall further being defined by a shear fastener hole, a shear bolt hole, and a shear plug weld hole, the shear walls forming a shear fastening hole, the shear walls forming a pair of shear vertical fastening holes;

at least one fillet weld at an intersection of the vertical frame members and the horizontal frame members;

a plate disposed adjacent to the top wall of the vertical frame members, the plate being defined by a plate fastener hole and a plate bolt hole;

at least one shear screw passing through the shear fastener hole and the plate fastener hole, the shear screw helping to fasten the shear block to the vertical frame member;

at least one plug weld in the plug weld hole, the plug weld helping to fasten the shear block to the horizontal frame member;

at least one elongated threaded bolt extending between the top wall of the vertical frame members, the threaded bolt passing through an open space in the horizontal frame members, the threaded bolt further passing through the vertical frame bolt hole, the plate bolt hole, and the shear bolt hole, the threaded bolt helping to fasten the horizontal and vertical frame members together;

at least one bolt nut, the bolt nut mating with the threaded bolt to help fasten the horizontal frame member to the vertical frame member; and at least one glass setting block operable to receive a pane of glass, the glass setting block resting on the top wall of the horizontal frame members and the vertical frame members.

20. A method for constructing a corner support assembly for a metal framed door, the method comprising:

aligning a pair of vertical frame members in a vertical orientation, the vertical frame members comprising a top wall, a bottom wall, sidewalls, and ends;

aligning a pair of horizontal frame members in a horizontal orientation, the horizontal frame members comprising a top wall defined by multiple horizontal molding installation grooves, a bottom wall, sidewalls, and ends;

joining the horizontal and vertical frame members at the ends to form a rectangular shape;

sliding at least one shear block into the ends of each vertical frame members by sliding the shear block rails into the vertical frame members multiple molding installation grooves;

aligning the shear block fastener holes and the shear block bolt hole, with the vertical frame members fastener holes and the vertical frame members bolt hole;

sliding a mounting plate into a vertical frame member open space until the mounting plate aligns with the threaded fastener holes and a mounting plate bolt hole, and further aligns with the shear block and a vertical frame member fastener hole and shear block and vertical frame members bolt holes;

passing at least one shear screw through the shear block fastener holes and the vertical frame member fastener holes, whereby the shear screw fastens the mounting plate through the threaded fastener holes;

passing a hex head self-tapping screw through the horizontal frame member in the at least one fastener hole, on the horizontal frame member top wall and bottom wall, whereby the hex head self-tapping screw fastens into the shear block at a shear block fastener pilot hole;

welding at least one fillet weld at an intersection of the vertical frame members and the horizontal frame members, between the vertical frame members top walls and the horizontal frame members top walls and bottom walls;

passing at least one shear screw through the shear fastener hole to help fasten the shear block to the vertical frame members;

driving at least one elongated threaded bolt between the top wall of the vertical frame members, the threaded bolt passing through an open space in the horizontal frame members;

drilling a 5⁄32"×1⁄8" deep shear plug weld hole in all the shear blocks, through the horizontal frame members top walls and bottom walls;

pouring solder through the 5⁄32"×1⁄8" deep shear plug weld hole to the top wall or the bottom wall of the horizontal frame member;

applying a glass setting block with existing adhesive over the hex head self-tapping screws, the glass setting blocks comprising multiple screw head punch outs;

mating a door molding on an interior side of a metal framed door, and with the multiple molding installation grooves, whereby the door molding snapping into the molding installation grooves;

placing an insulated pane of glass into an open space of the metal framed door, whereby the pane of glass rests on the interior side of the metal framed door, and on top of the glass setting block; and installing the horizontal door moldings on an exterior side of the metal framed door, and into the molding installation grooves on the exterior side of the metal framed door, whereby the door moldings help secure the glass pane in place.

* * * * *